US007458661B2

(12) United States Patent
Kim et al.

(10) Patent No.: US 7,458,661 B2
(45) Date of Patent: Dec. 2, 2008

(54) METHOD AND APPARATUS FOR PROMOTING THE COMPLETE TRANSFER OF LIQUID DROPS FROM A NOZZLE

(75) Inventors: Chang-Jin Kim, Beverly Hills, CA (US); Uichong Brandon Yi, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 319 days.

(21) Appl. No.: 11/275,668

(22) Filed: Jan. 23, 2006

(65) Prior Publication Data

US 2006/0164490 A1 Jul. 27, 2006

Related U.S. Application Data

(60) Provisional application No. 60/647,130, filed on Jan. 25, 2005.

(51) Int. Cl.
*B41J 2/14* (2006.01)
*B41J 2/16* (2006.01)

(52) U.S. Cl. ..... 347/47; 347/48; 347/45

(58) Field of Classification Search ..... 347/20, 347/44–47, 55, 56, 61–65, 67, 103, 348
See application file for complete search history.

(56) References Cited

U.S. PATENT DOCUMENTS 4,791,436 A * 12/1988 Chan et al. ..... 347/47
5,387,440 A * 2/1995 Takemoto et al. ..... 347/45
6,315,397 B2 * 11/2001 Truninger et al. ..... 347/63

* cited by examiner

*Primary Examiner*—Juanita D Stephens
(74) *Attorney, Agent, or Firm*—Vista IP Law Group LLP

(57) ABSTRACT

A printhead device for transferring liquid droplets from a nozzle includes a liquid source coupled to a nozzle via a microchannel. The nozzle is formed from an orifice having an inner circumferential surface, wherein at least a portion of the inner circumferential surface is serrated. Liquid droplets are transported from the source to the nozzle using a liquid droplet driver (e.g., employing a plurality of driving electrodes). Transfer of droplets to another surface can be accomplished by contacting a bulging droplet in the nozzle with a printing surface. The surface and/or nozzle are then moved relative to one another to effectuate complete transfer of the liquid drop from the nozzle.

24 Claims, 7 Drawing Sheets

FIG. 4A
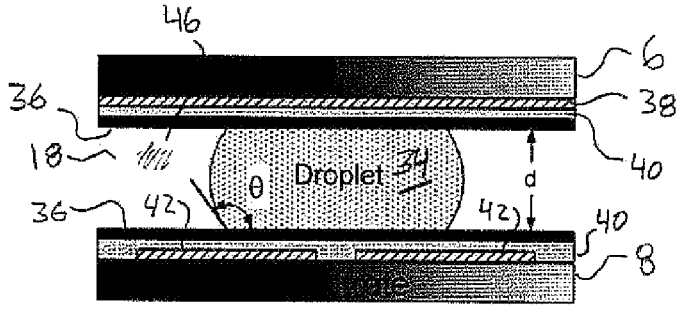
FIG. 4B
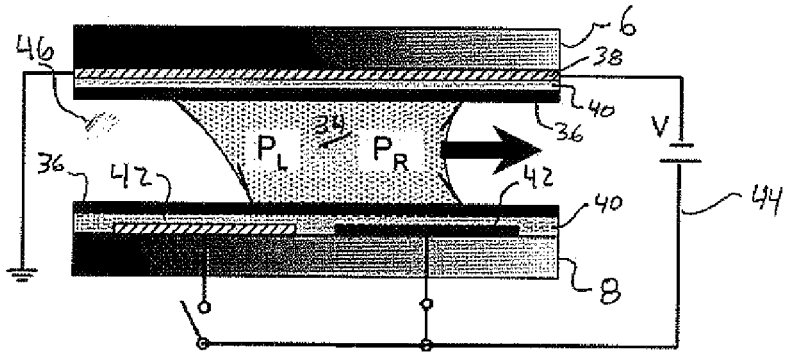
Electrode Energized Electrode Dielectric layer Hydrophobic layer
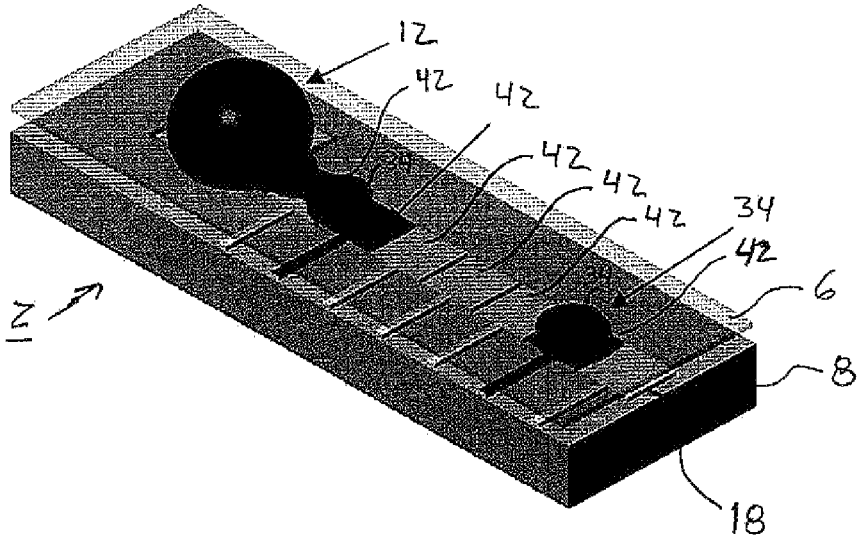
FIG. 5

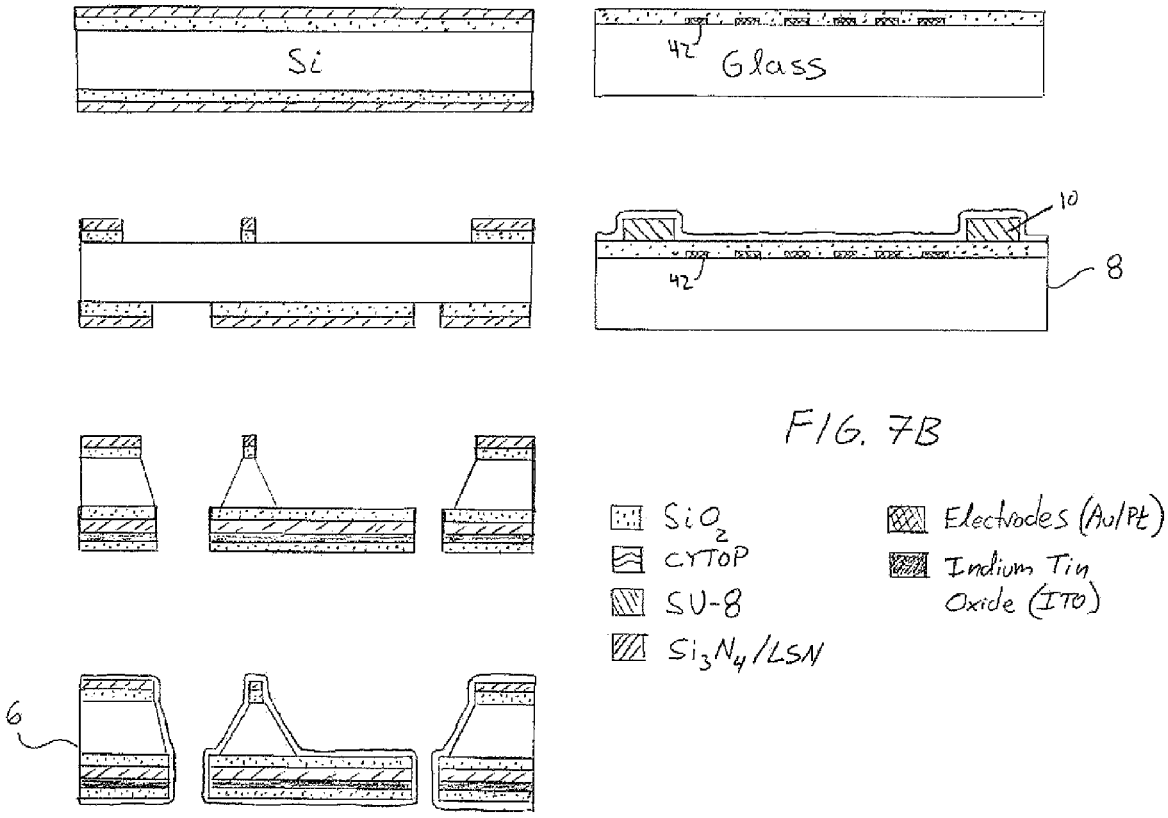
FIG. 7B
FIG. 7A
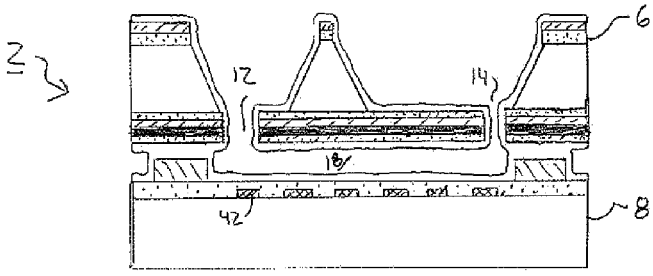
FIG. 7C

METHOD AND APPARATUS FOR PROMOTING THE COMPLETE TRANSFER OF LIQUID DROPS FROM A NOZZLE

Reference To Related Applications

This Application claims priority to U.S. Provisional Patent Application No. 60/647,130 filed on Jan. 25, 2005. U.S. Provisional Patent Application No. 60/647,130 is incorporated by reference as if set forth fully herein.

STATEMENT REGARDING FEDERALLY SPONSORED RESEARCH AND DEVELOPMENT

The U.S. Government may have a paid-up license in this invention and the right in limited circumstances to require the patent owner to license others on reasonable terms as provided for by the terms of Grant No. CMS-99-80874 by the National Science Foundation and Grant No. NCC21364 by the National Aeronautics and Space Administration.

FIELD OF THE INVENTION

The field of the invention generally relates to devices used to transfer liquid droplets from an orifice or nozzle. The device may be used to transfer liquid droplets from one surface to another. In particular, the field of the invention relates to nozzles having geometric surface modifications to promote the complete transfer of liquid droplets to their intended destination such as a printing surface.

BACKGROUND OF THE INVENTION

There is a growing demand for devices that are able to generate microscopic-sized liquid droplets, and in many cases to print onto solid surfaces. As a biomedical example, microarray technology has been developed to detect and analyze proteins and/or nucleic acid material (e.g., DNA or RNA) within a sample. These devices utilize highly parallel hybridization assays using an array of testing sites with deposited samples on a chip or slide. This technology has been useful in gathering information for genetic screening and expression analysis, as well as the detection of single nucleotide polymorphisms (SNPs). In addition, microarray technology can be utilized in other areas such as pharmacology research, infectious and genenomic disease detection, cancer diagnosis, and proteonomic research.

These microarray devices, however, require the formation of high-density hybridization sites or spots on a solid surface. The high-density array of test sites is generally formed using either photolithographic patterning techniques, mechanical microspotting, or inkjet like printing. The photolithographic method fabricates microarrays through on-chip chemical synthesis of DNA molecules using spatially directed exposure of light to selectively de-protect regions of the substrate. Affymetrix, Inc. of Santa Clara, Calif., for example, has developed this approach. While high-density test sites may be created using this method, there are significant manufacturing costs due to the use of light blocking masks and related lithographic equipment. This process, while suitable for large-scale production, is simply too expensive for small or intermediate scale productions.

In a second method, mechanical micro spotting is used to print small amounts of solutions onto solid surfaces such as glass, silicon, or plastic substrates to form a testing array. The mechanical micro spotting technique utilizes multiple fountain pen-like pins that leave droplets on the solid surface after contact is made between the pen "tip" and the surface. This method is generally simple and inexpensive for making a small number of microarray chips. Unfortunately, after repeated use, the tip of the pin (which is typically stainless steel) tends to deform plastically, thereby resulting in test sites having inconsistent spot size and shapes.

In yet a third method, inkjet printing techniques are employed that forcibly eject fluid droplets from a printhead structure. The ejected droplets fly through the air and land on the substrate. While inkjet technology is mature and widely used in the case of traditional inkjet printers (used in the home and in business), the same technology cannot be directly translated into microarray applications. For example, in microarray applications, the droplets contain specific quantities of biological material (e.g., nucleic acids). Unfortunately, the number of samples deposited per area on the surface (i.e. average sample density on a spot) may vary widely because of splashing or spreading of droplets on the printing surface which could result in inconsistent hybridization data being generated.

More recently, a technique of "soft printing" has been developed to transfer droplets containing a biological material from one surface to another. Soft printing involves transfer of one or more droplets through liquid-solid contact. This method avoids the limitation described above with respect to pin-based (mechanical) printing and inkjet-based printing. While consistent volumes of droplets can be generated with soft printing print heads, this consistency was found to be compromised after printing because the printing action leaves a small, but noticeable residual volume behind in the nozzle. In addition, the residual volume could be a potential source of cross-contamination for subsequent printing processes.

There thus is a need for a print head device teat promotes the complete or substantially complete transfer of discrete drops from a nozzle. In this regard, no residual droplet material remains in the nozzle after printing. Such a device would enable the printing of different sample droplets through a single nozzle, enabling a flexible and compact system. In addition, such a device would improve printing efficiency since little or no cleaning steps would be required to avoid cross-contamination among printed spots.

SUMMARY OF THE INVENTION

The present invention is directed to a nozzle design that permits the complete transfer of liquid droplets from the nozzle to there intended destination. For example, the invention may be used to transfer liquid droplets from one surface to another. The nozzle design can be implemented into various microfluidic-based structures that require the transfer or ejection of fluid. One such application is the printing or transfer of small volumes of liquids containing biological materials. As one example, the nozzle and printing method described herein may be used to print high-density arrays of test sites on a substrate such as glass.

In one embodiment, the nozzle is formed as an orifice having an inner circumferential surface, of which, at least a portion is serrated. The orifice may be substantially circular in shape although other geometries are contemplated. A transfer device such as a printhead may include one or more of such nozzles.

In another embodiment, a printhead for transferring liquid droplets to a printing surface includes a liquid source and a nozzle in fluid communication with the liquid source. The nozzle includes a substantially circular orifice having an inner circumferential surface, of which, at least a portion is serrated. The serrations generally comprise plurality of radically-oriented projections. The projections may have a number of geometric shapes including rectangular, square, triangular, or sinusoidal. The serrations may even be formed by a roughened inner circumferential surface.

In still another embodiment, a device for transferring liquid droplets to a surface includes a substrate and a plurality of liquid sources disposed in the substrate, with each source being coupled to a microchannel contained with the substrate. Each micro channel is further coupled to a nozzle, wherein each nozzle includes a substantially circular orifice having an inner circumferential surface, of which, at least a portion is serrated. A droplet driver may be associated with each micro channel for transporting liquid fluid from the source(s) to the nozzles.

In one embodiment, the droplet driver may use a plurality of electrodes used for the electowetting-based or dielectrophoresis-based (DEP) manipulation of droplets. Still other driver mechanisms include thermal-based as well as acoustic wave-based drivers.

In another embodiment, a method of transferring or printing liquid droplets to a surface includes the steps of providing a printhead for transferring liquid droplets to a surface. The printhead includes at least one nozzle having a substantially circular orifice having an inner circumferential surface, of which, at least a portion is serrated. A source of liquid is loaded into the printhead device, typically within a reservoir. Alternatively, the source of liquid may come from an external instrument that is coupled to the device via one or more connections. In still another example, the liquid reservoir may be loaded into the device. One or more droplets are transported from the liquid source to the nozzle having the serrated surface. The droplet is positioned under the nozzle such that a portion of the droplet bulges or projects outward from the nozzle outlet. A printing surface is brought in close proximity to the nozzle outlet and contacts the droplet. Relative movement between the printing surface and the nozzle is then initiated to pull the printing surface and/or nozzle away from one another. The separation of the two structures effectuates the complete transfer of the droplet from the nozzle to the printing surface.

It is thus one object of the invention to provide a nozzle design that permits the complete transfer of a droplet from one surface to another. It is a related object of the invention to provide a microfluidic-based device that is able to print or transfer droplets to their destination without leaving any residue behind. Further features and advantages will become apparent upon review of the following drawings and description of the preferred embodiments.

BRIEF DESCRIPTION OF THE DRAWINGS

FIG. 4A illustrates a droplet located within a passageway such as a microfluidic channel having a plurality of electrodes used for the EWOD-based transport of the droplet. FIG. 4A illustrates the droplet prior to application of a voltage to the electrode.

FIG. 4B illustrates the same droplet of FIG. 4A after a voltage is applied to the right-most electrode. The droplet is shown moving in the direction of the arrow (right).

FIG. 5 illustrates a three-dimensional perspective view of a EWOD-based printhead. Two droplets are shown being transported by the driving electrodes.

FIG. 7A schematically illustrates a process for forming the top or upper portion of a printhead.

FIG. 7B schematically illustrates a process for forming the bottom or lower portion of a printhead.

FIG. 7C illustrates the completed print head with the top and bottom portions of FIGS. 7A and 7B being bonded together to form a single structure.

FIG. 8A also illustrates a glass printing surface being brought in close proximity to the nozzle outlet of the printhead device.

DETAILED DESCRIPTION OF THE PREFERRED EMBODIMENTS

Figure 1A:
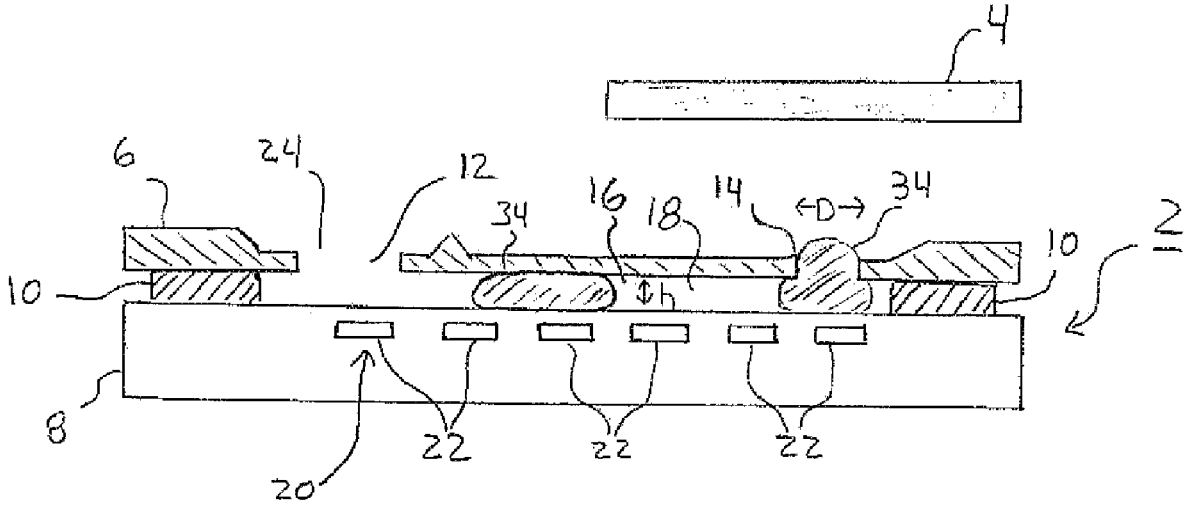
FIG. 1A is a side cross-sectional view of a printhead for transferring liquid droplets according to one embodiment. This printhead in this embodiment schematically illustrates an electrowetting-on-dielectric (EWOD) based print head for the soft printing of droplets on the bottom surface of a substrate.
Figure 1B:
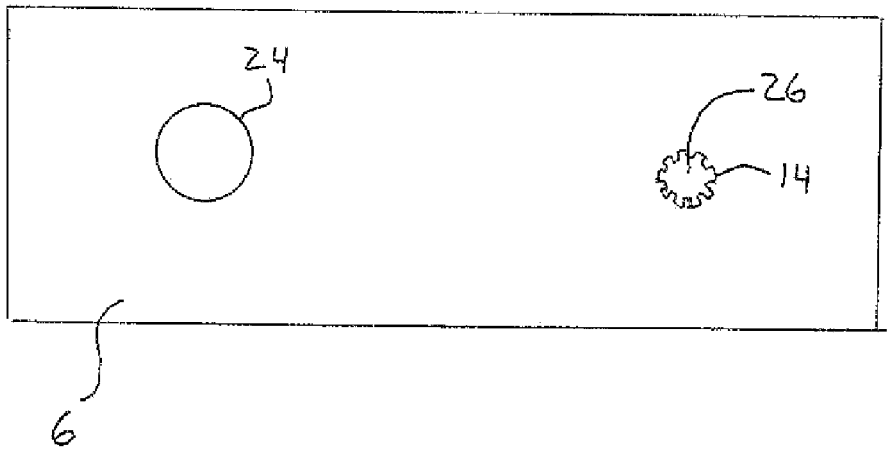
FIG. 1B is a top down plan view of the printhead illustrated in FIG. 1A. The liquid source and serrated nozzle are shown in the upper surface of the printhead.

FIGS. 1A and 1B schematically illustrate a printhead device 2 for transferring liquid droplets 34 to a surface 4. In one embodiment, the printhead 2 is formed using an upper portion 6 and a lower portion 8 that are separated from one another via a spacer 10 or the like. The assembled print head 2 includes a liquid source 12 that is fluidically connected to a nozzle 14. For instance, the liquid source 12 may be coupled to the nozzle 14 via a passageway 16, which in certain embodiments, may comprise a microfluidic channel 18. In certain embodiments, the liquid source 12 may comprise a reservoir. FIGS. 1A and 1B also illustrate a printing surface 4 in close proximity to the outlet of the nozzle 14. The printing surface 4 may be formed from a wetting (e.g., hydrophilic) substrate, for example, a glass plate or the like.

The upper portion 6 of the print head 2 may be formed within a substrate such as a silicon wafer by using conventional semiconductor processing techniques. For example, the upper portion 6 may be formed by micro-machining of a silicon wafer. The lower portion 8 of the printhead 2 may be formed from another substrate, for example, a glass plate or the like. As shown in FIG. 1A, the lower portion 8 of the printhead 2 may include a liquid droplet driver 20 that moves or transports liquid droplets 34 from the liquid source 12 to the nozzle 14. As seen in FIG. 1A, the liquid droplet driver 20 may formed using a plurality of driving electrodes 22. The driving electrodes 22 impart motion to individual liquid drops through the selective application of voltage to the electrodes 22 (described in more detail below). The use of electrowetting-on-dielectric (EWOD) electrodes 22 permits the manipulation of droplets 34 within the passageway 16 by controlling the surface wettability of the individual liquid droplets 34.

The upper portion 6 of the print head 2 may include spacers 10 which are then bonded to the lower portion 8 to create the print head 2. As best seen in FIG. 1B, the upper portion 6 of the print head 2 includes an inlet 24 that provides access to the liquid source 12. The upper portion 6 also includes an outlet 26 in the form a nozzle 14. The interior surfaces of the print head 2 (e.g., source 12, passageway 16, and nozzle 14) may be coated with a non-wetting coating 28 (e.g. hydrophobic coating).

Figure 2:
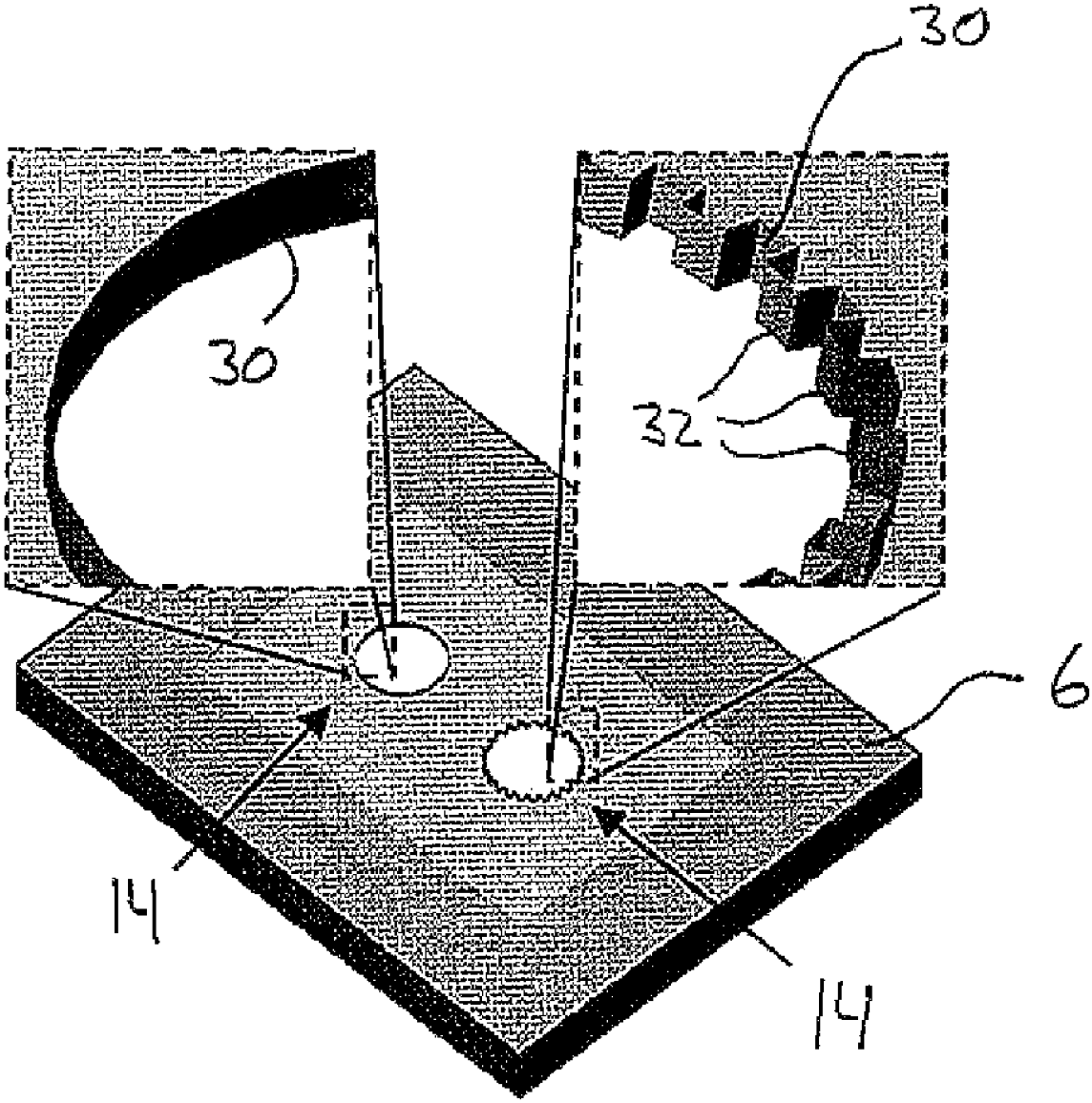
FIG. 2 illustrates a partially exploded views of two nozzles used in a printhead. The nozzle on the left side of the page is an unmodified nozzle while the nozzle on the right side of the pate has a serrated inner circumferential surface.

With reference to FIG. 2, in one aspect of the invention, the nozzle 14 includes a substantially circular orifice having an inner circumferential surface 30. At least a portion of the inner circumferential surface 30 is serrated. By serrating the inner circumferential surface 30 of the nozzle 14, the liquid-solid surface energy inside the nozzle 14 can be reduced substantially. The reduction in energy within the nozzle 14 thus reduces the pull-back or adhesion of the liquid within the nozzle 14. Consequently, droplets 34 of liquid located within the nozzle 14 are able to be completely transferred to a printing surface 4 during a soft printing operation.

The serrated portion of the inner circumferential surface 30 of the nozzle 14 may be formed by a plurality of radically-oriented projections 32. The projections 32 may have a variety of geometric shapes or profiles. For instance, the projections 32 may be square, rectangular, triangular, sinusoidal, and the like. The projections 32 may be formed in regular patterns. In still another aspect, the serrated portion of the inner circumferential surface 30 may be formed from a roughened surface.

FIG. 2 illustrates a partial exploded view of two nozzles 14 contained in an upper portion 6 of a print head 2. The nozzle on the left 14 does not include a serrated inner circumferential surface 30 while the nozzle on the right includes radically-oriented projections 32 to form the serrated surface.

Figure 3:
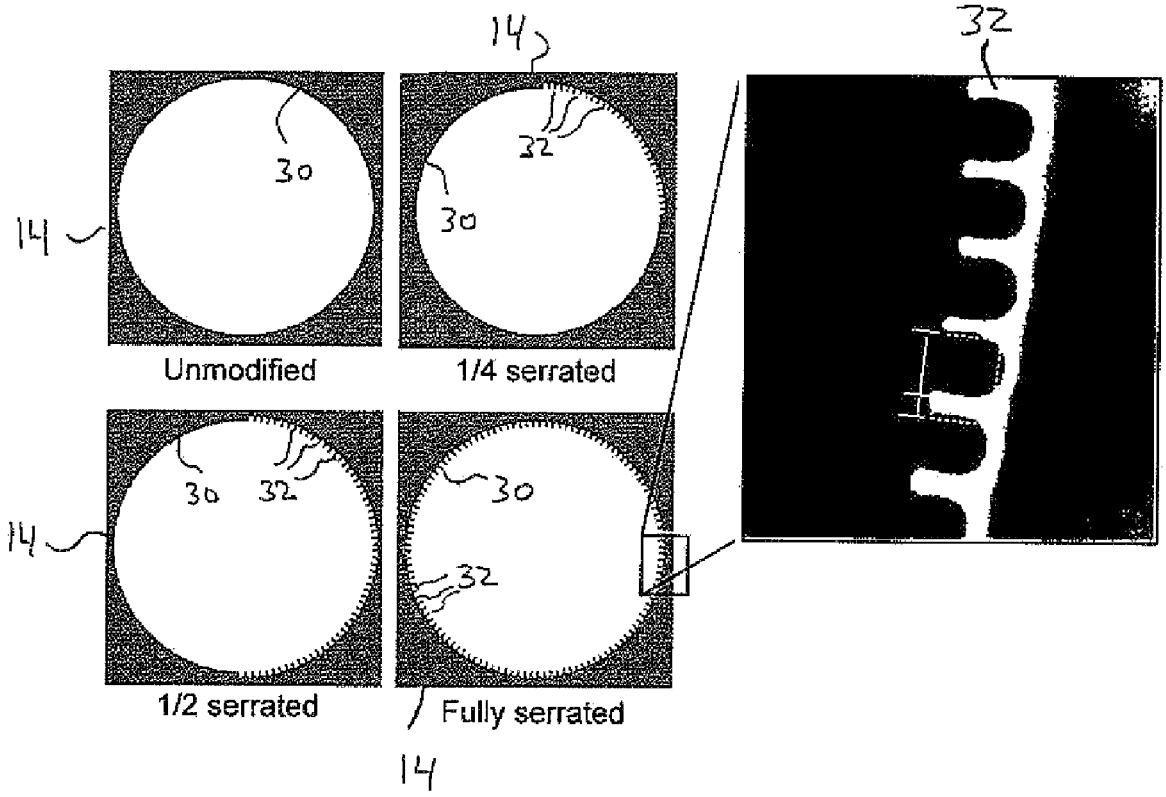
FIG. 3 illustrates top down panel views of various nozzles. The upper left image shows an unmodified nozzle. The upper right image illustrates a nozzle with one-quarter of the inner circumferential surface being serrated. The lower left image illustrates a nozzle with one-half of the inner circumferential surface being serrated. The lower right image illustrates a nozzle with the entire inner circumferential surface being serrated. A magnified view of a portion of the serrations in the lower right image is also shown.

In accordance with one aspect of the invention, at least a portion of the inner circumferential surface 30 is serrated. FIG. 3 illustrates an unmodified nozzle 14 with no serrations (upper left) as well as nozzle 14 configurations with one-quarter serrated (upper right), half-serrated (lower left), and fully serrated (lower right). The degree of serration required may depend on the nature of the fluid being transferred. For example, a solution containing DNA (Calf Thymus, 4 μg/ml) required that at least half of the inner circumferential surface 30 be serrated. FIG. 3 also shows a partially magnified micrograph photo illustrating the radically-oriented projections 32 that form the serrated surface.

As best seen in the partially magnified view of FIG. 3, the liquid-solid interface between the droplet 34 and the nozzle 14 is limited to the ends or tips of the radically-oriented projections 32. By way of illustration and not limitation, length of the liquid-solid interface between the droplet 34 and each radically-oriented projection 32 may be on the order of several microns. The nozzle 14 design described herein may result in a significant reduction in the liquid-solid interface area (around 70%) when compared to an unmodified nozzle 14.

Figure 8A:
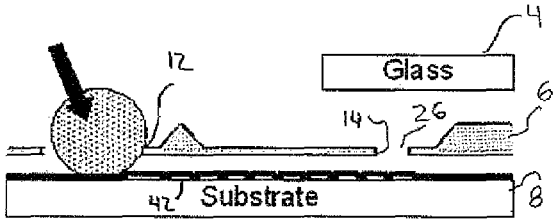
FIG. 8A illustrates a liquid sample being loaded into a printhead device.
Figure 8B:
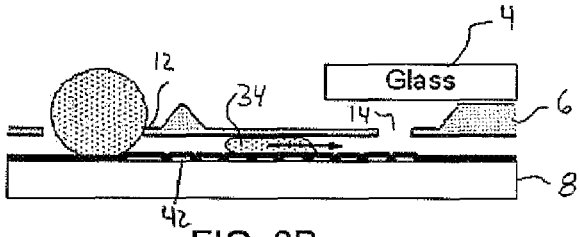
FIG. 8B illustrates the transfer of a discrete liquid droplet from the liquid source toward the nozzle of the printhead device. The droplet is shown moving within a passageway of the microchannel (without sidewalls) in the direction of the arrow (right).
Figure 8C:
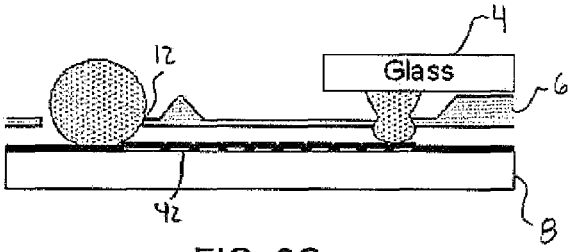
FIG. 8C illustrates a droplet bulging outward from the nozzle of the print head device. The droplet is also shown contacting the lower surface of the printing surface.

Referring to FIGS. 1A and 8C when the droplet 34 is moved underneath the nozzle 14, the droplet 34 enters the nozzle 14 and bulges or projects outwardly from the upper portion 6 of the print head 2. The bulging of the droplet 34 is caused by the pressure imbalance created within the droplet 34. Generally, the channel height (h) (as shown in FIG. 1A) should be less than the nominal diameter (D) of the outlet 26 of the nozzle 14 to promote the bulging of the droplet 34 from the nozzle 14.

FIGS. 4A and 4B illustrate the transport of a droplet 34 within a microfluidic channel 18 of a printhead 2. The interior surface of the microfluidic channel 18 has or is coated with a non-wetting (e.g., hydrophobic layer) 36. In addition, as seen in FIGS. 4A and 4B, the upper portion 6 of the printhead 2 contains a single electrode 38 that is separated from the upper interior surface of the microfluidic channel 18 via a dielectric layer 40. The lower portion 8 of the print head 2 contains a plurality of switchable driving electrodes 42. The driving electrodes 42 are separated from the lower interior surface of the microfluidic channel 18 via a dielectric layer 40. As best seen in FIG. 4B, the plurality of driving electrodes 42 are connected to switching circuitry 44 that selectively charges or "energizes" selected driving electrodes 42 with a voltage.

FIG. 4A illustrates the droplet 34 when no voltage is applied to the electrode 42 (open circuit condition). In contrast, FIG. 4B illustrates the droplet 34 after the rightmost driving electrode 42 is energized. The application of an electric potential (V) across the droplet 34 asymmetrically between opposing sides of the droplet 34 inside the microfluidic channel 18 induces corresponding asymmetrical changes in the contact angles of the droplet 34 with the microfluidic channel 18. The asymmetrical changes in contact angles results in a differential internal pressure within the droplet 34 that moves the droplet 34 along the micro fluidic channel 18. In the example illustrated in FIGS. 4A and 4B, the droplet 34 motes to the right (in the direction f the arrow in FIG. 4B) because the internal pressure in the left direction ($P_L$) is greater than the internal pressure in the right direction ($P_R$).

By using this EWOD-based driving technique, the droplet 34 can be manipulated in a user-directed manner by selectively energizing the electrodes 42 embedded underneath the dielectric layers 40. This same technique can also be used to generate discrete droplets 34 from a larger reservoir of liquid contained in the liquid source 12.

Still referring to FIGS. 4A and 4B, it should be understood that individual droplets 34 contained in the device 2 are carried by a filling fluid 46 that that is present in the spaces not occupied by the droplets 34. The filling fluid 46 is generally immiscible with the droplets 34. For example, if the droplet 34 is formed from water, the filling fluid 46 may be formed from an oil-based material or air.

FIG. 5 illustrates a three-dimensional view of a print head 2 device using EWOD driving electrodes 42 to transport individual droplets 34 from the liquid source 12 to the nozzle 14. A first droplet 34 is shown being created from the liquid source 12 and beginning its journey down the microfluidic channel 18. A second droplet 34 is also shown moving along the microfluidic channel 18 some distance from the liquid source 12. The underlying "energized" driving electrodes 42 are also shown.

Figure 6:
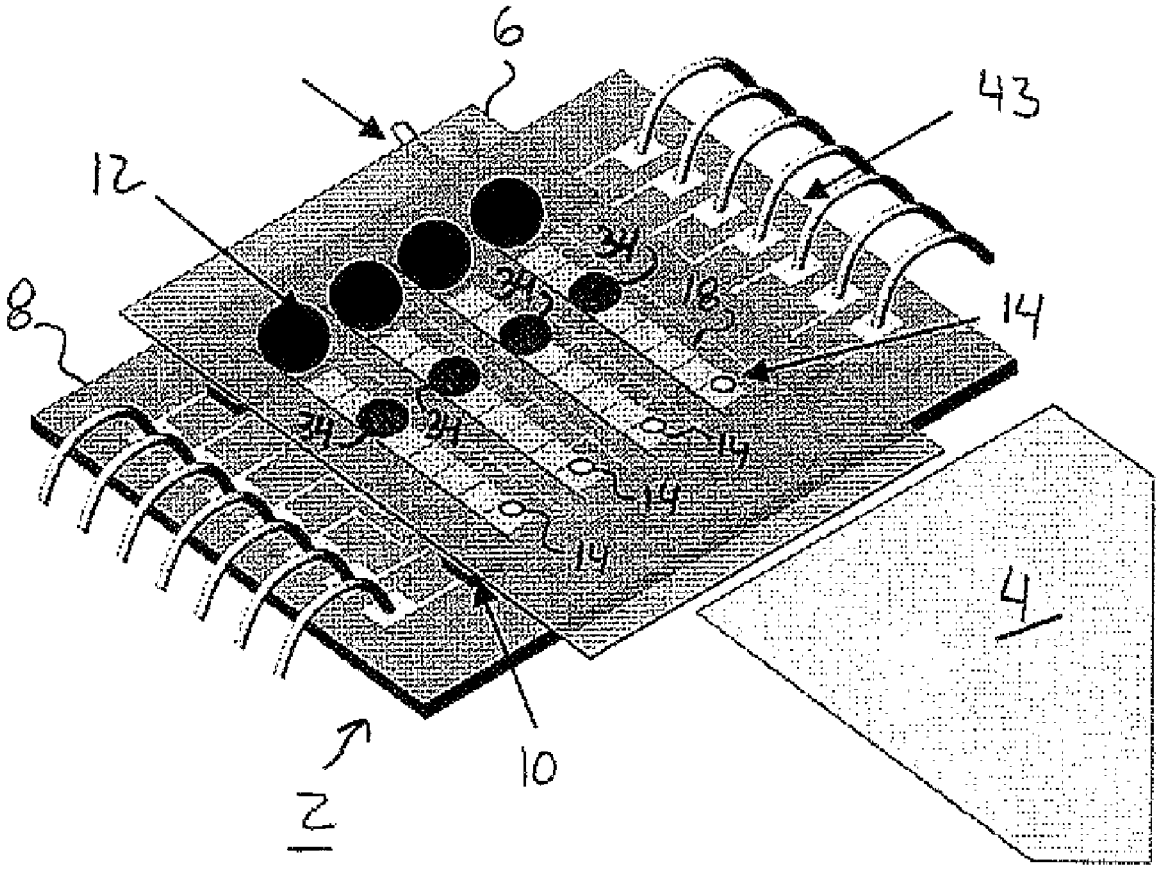
FIG. 6 illustrates a three-dimensional perspective view of fabricated printhead having multiple nozzles arranged in a plurality of rows or lanes.

FIG. 6 illustrates a three-dimensional view of a printhead 2 testing device. The printhead 2 includes an upper portion 6 and a lower portion 8 separated via a spacer 10. The printing surface 4 is formed from a glass plate. The lower portion 8 includes the electrical connections 43 for the switching circuitry 44 (shown in FIG. 4B) used for EWOD-based droplet 34 generation and transport. The printing surface 4 was connected to an xyz stage (not shown) for manipulating the printing surface 4 for printing. The device 2 included a plurality of lanes (four such lanes are shown in FIG. 6, with each lane having liquid source 12 connected to a nozzle 14 via a microfluidic channel 18.

In the testing device 2 shown in FIG. 6, the height of the microfluidic channel 18 was around 50 μm while the diameter of the nozzles 14 were about 400 μm. A water and DNA solution (Calf Thymus DNA solution diluted with water to 4 μg/ml) was used for testing. After 1 μl of liquid was pipetted into each of four liquid sources 12, droplets 34 were created and transported by EWOD to the nozzle 14. The droplets 34 were generated with an applied voltage of 85 $V_{AC}$ and transported with 55 $V_{AC}$.

After the droplets 34 arrived under the nozzles 14 and the driving potential was removed, the droplets 34 bulged out through the outlet 26 of the nozzles 24. A printing surface 4 (e.g., glass plate) was positioned over the nozzle 14 and moved down (as shown in FIG. 8C). Once the printing surface 4 touched the droplets 34, the droplets 34 were transferred to the hydrophilic glass surface from hydrophobic nozzle 14. The printing surface 4 was then stepped (to the left) to the next position and viewed with a microscope (not shown). Droplets 34 with approximately 100 nl in volume were generated and printed with the array of four nozzles 14.

Generally, slightly higher voltages were needed for moving droplets 34 under the nozzles 14 than the minimum voltage for moving droplets 34 inside the microfluidic channels 18. Since the areas occupied by nozzles 14 reduce the total area for EWOD actuation, slightly higher voltages are needed to place the droplets 34 under the nozzles 14 for compensation. However, the operating voltage can be reduced by using a larger driving electrode 42 under the nozzle 14 if needed.

FIGS. 7A, 7B, and 7C illustrate a process for fabricating a printhead 2. Generally, the process is divided into two parts: a first process (FIG. 7A) to form the upper portion 6 of the printhead 2 and a second process (FIG. 7B) to form the lower portion 8 of the printhead 2. The upper portion 6 and the lower portion 8 are then bonded together (FIG. 7C) to form the completed device 2.

Referring to FIG. 7A, the process for the upper portion 6 strats by growing $SiO_2$ and depositing $Si_3N_4$ layers using Low-Pressure Chemical Vapor Deposition (LPCVD) as a KOH etching mask on a 100 μm-thick 4-inch Si wafer. On the bottom side of the Si wafer, and approximately 1.5 to 2.0 μm-thick low-stress silicon nitride (LSN) layer is deposited by PECVD to form a top layer of the microfluidic channel 18. The $SiO_2$ and $Si_3N_4$ layers on the top side of the safer are then patterned by Reactive Ion Etching (RIE) for KOH etching of the Si wafer. Similarly, the LSN layer on the bottom is patterned to form nozzles 14 and liquid sources 12, also by RIE. The Si wafer is etched by a KOH solution, revealing a LSN membrane, followed by the deposition of an Indium Tin Oxide (ITO) layer (electrode 38) on the membrane for an electrical ground during EWOD actuation. Then, another Plasma Enhanced Chemical Vapor Deposition (PECVD) $SiO_2$ layer is deposited for electrical passivation. Both surfaces of the processed wafer are then spin-coated with an ample amount of CYTOP solution to maximize the coating uniformity.

For the testing device 2 (e.g., as shown in FIG. 6), the LSN layer maximizes the bulging height of the droplet 34 within a given volume. In addition, the LSN layer was transparent for visualizing the droplets 34 within the microfluidic channels 18. CYTOP was used to maintain an uniform hydrophobicity on the inner surfaces of the printhead 2. CYTOP wets surfaces better during spin coating processes and can be used as a bonding material as well.

FIG. 7B illustrates a process for forming the lower portion 8 of the device 2. Initially, a 700 μm-thick glass substrate was subject to electron-beam evaporation and patterning of a gold layer form 1000 Å-thick driving electrodes 42. A Low-Pressure Chemical Vapor Deposition (LPCVD) $SiO_2$ layer was deposited on the patterned electrodes for electrical passivation. Next, a spacer 10 was formed by spin-coating and patterning of a photo resist layer (SU-8). The spacer 10 defines the height of the microfluidic channel 18. After spacer 10 formation, the upper surface was subject to spin-coating of CYTOP for hydrophobic coating.

With reference now to FIG. 7C, after both the upper portion 6 and lower portions 8 are completed, the two portions 6, 8 are brought together and bonded by applying approximately 5 MPa pressure at 170° C. for 30 min. The CYTOP layers on the LSN membrane and on the spacers work as bonding layers, while making the inside surfaces of the microfluidic channel 18 hydrophobic.

FIGS. 8A-8D illustrate a process of transferring or printing a droplet 34 onto a printing surface 4 from a printhead 2. Referring to FIG. 8A, liquid source is placed in the liquid source 12. The liquid source may be placed into the source 12 using a pipette or similar means. Alternatively, the printhead 2 may be integrated with other microfluidic components (not shown) such that the liquid source 12 may be serially or continuously replenished. In an alternative embodiment, the source 12 may be omitted entirely if the microfluidic channel 18 is coupled to a source of liquid for the droplets 34.

The liquid source may include a reagent, dye, marker or the like that can be later transferred to a printing surface 4. In addition, the liquid source may include one or more biological materials that can then be deposited in pattern or array of test sites on a printing surface 4. For example, the droplets 34 may contain nucleic acids (e.g., DNA, RNA), proteins, enzymes, and the like.

Still referring to FIG. 8A, the printing surface 4 is brought in close proximity to the outlet 26 of the nozzle 14. This may be done using a moving stage or the like (not shown) that moves the printing surface 4 near the nozzle 14 of a stationary printhead 2. Alternatively, the printhead 2 may be moved in close proximity to a stationary printing surface 4. In still another aspect, both the printing surface 4 and the nozzle 14 may be moved relative to one another.

FIG. 8B illustrates the generation and transport of a droplet 34 within the microfluidic channel 18 of the device 2. In the device 2 of FIG. 8B, a plurality of EWOD-based driving electrodes 42 are used to generate (e.g., digitize) individual droplets 34 from the liquid source 12. The droplets 34 are then transported along the microfluidic channel 18 in the direction of the arrow in FIG. 8B.

Figure 8D:
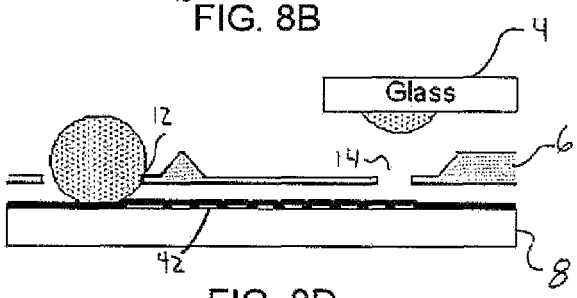
FIG. 8D illustrates movement of the printing surface away from the nozzle to effectuate the complete transfer of the liquid droplet from the nozzle to the printing surface.

Once the droplet 34 has been transported underneath the nozzle 14, the droplet 34 bulges out of the outlet 26 of the nozzle 14 and touches the underside of the printing surface 4 (shown in FIG. 8C). After the bulged droplet 34 on the hydrophobic nozzle 14 touches the hydrophilic printing surface 4, the liquid is transferred to the printing surface 4 based on the wet ability differences. In order to completely transfer the droplet 34 to the printing surface 4, either (or both) of the printing surface 4 and printhead 2 are moved away relative to one another. The entire droplet 34 is then transferred from the nozzle 14 to the printing surface 4 as shown in FIG. 8D.

In accordance with the present invention, the printhead 2 can be constructed to include an array of nozzles 14. The nozzles 14 may be positioned across a number of rows or columns (e.g., lanes). In addition, a single lane my have a plurality of nozzles 14. In this regard, the overall throughput of the device 2 can be increased and integrated into a relatively small footprint.

Figure 9A:
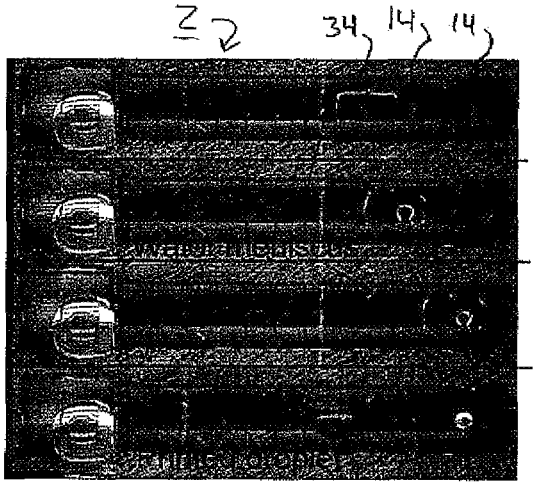
FIG. 9A is a photographic image of a printhead having multiple (two) nozzles positioned within a single passageway or channel. The driving signal for the underlying electrodes was programmed such that the droplet passed the first nozzle to stop at the second nozzle.

FIG. 9A illustrates an embodiment of a printhead 2 that has a plurality of nozzles 14 (two in FIG. 9A) located within a single microfluidic channel 18. In this embodiment, droplets 34 are transferred in the same manner as described above with the exception that the driving electrode signal was programmed to pass the droplet 34 by the first nozzle 14 and stop at the second nozzle 14. In order to pass the droplet 34, the driving electrode 42 located beneath the nozzle 14 to be passed is energized. The driving electrode 42 located beneath the second nozzle 14 was turned off to delivery the droplet 34 to the nozzle 14 of interest.

Figure 9B:
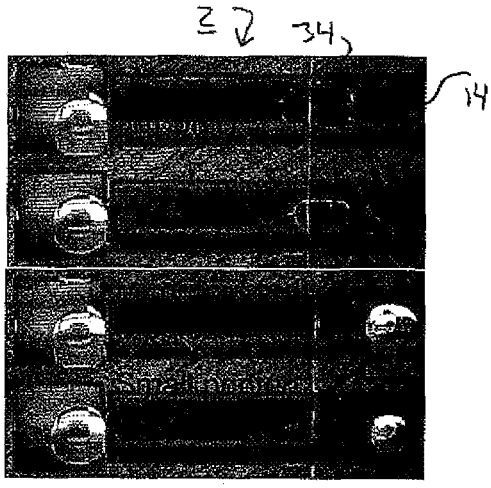
FIG. 9B is a photographic image of a print head used to print or transfer droplets having different volumes (large vs. small). The resultant printed droplets are shown in the two lowermost images shown in FIG. 9B.

FIG. 9B illustrates an embodiment wherein the size of the printed spot is controlled by altering the volume of the droplet 34. Two droplets 34 of different volumes were delivered and printed onto a printing surface 4. The larger droplet 34 shown in FIG. 9B was created by merging two smaller droplets 34 generated from the same liquid source 12. The two lower images in FIG. 9B illustrate that the larger droplet 34 generates a larger spot on the printed surface 4. Consequently, by adjusting or controlling the size of the droplets 34, the size of the resultant spots can be controlled.

It should be understood that the nozzle 14 described herein may be use to transmit droplets 34 from the nozzle 14 with or without a printing surface. For example, the droplets 34 may be ejected into a void or space without a printing surface per se. The droplets 34 may be ejected by tapping or rapid movement of the printhead 2.

While embodiments of the present invention have been shown and described, various modifications may be made without departing from the scope of the present invention. The invention, therefore, should not be limited, except to the following claims, and their equivalents.

What is claimed is:

1. A device for transferring liquid droplets comprising:

a nozzle having an orifice with an inner circumferential surface, wherein at least a portion of the inner circumferential surface is serrated;

a liquid source and a passageway connecting the liquid source to the nozzle; and a plurality of driving electrodes disposed in the passageway.

2. The device of claim 1, wherein at least half of the inner circumferential surface is serrated.

3. The device of claim 1, wherein the entire inner circumferential surface is serrated.

4. The device of claim 1, wherein the inner circumferential surface is coated with a non-wetting material.

5. The device of claim 1, wherein the serrated portion of the inner circumferential surface comprises a plurality of radially-oriented projections.

6. The device of claim 5, wherein the plurality of radially-oriented projections has geometric shape selected from the group consisting of rectangular, square, triangular, and sinusoidal.

7. The device of claim 1, wherein the passageway comprises a microchannel.

8. The device of claim 7, wherein the microchannel has a height that is less than the nominal diameter of the nozzle.

9. The device of claim 1, wherein the device includes a plurality of nozzles.

10. The device of claim 1, wherein the serrated inner circumferential surface comprises a roughened surface.

11. A device for transferring liquid droplets comprising:

a substrate;

a plurality of liquid sources disposed in the substrate, each source being coupled to at least one microchannel contained in the substrate and each microchannel being further coupled to a nozzle, wherein each nozzle comprises a substantially circular orifice having an inner circumferential surface, wherein at least a portion of the inner circumferential surface is serrated; and a plurality of driving electrodes disposed along at least a portion of each microchannel for transporting fluid from the sources to the nozzles.

12. The device of claim 11, wherein the height of each microchannel is less than the diameter of the coupled nozzle.

13. The device of claim 11, wherein the liquid droplets contain biological material.

14. A method of transferring liquid droplets to a surface comprising:

providing a printhead for transferring liquid droplets to a surface, the printhead comprising:

a liquid source;

a nozzle in fluid communication with the liquid source, the nozzle comprising a substantially circular orifice having an inner circumferential surface, wherein at least a portion of the inner circumferential surface is serrated; and a liquid droplet driver for transporting fluid from the liquid source to the nozzle, the liquid droplet driver comprising a plurality of driving electrodes;

providing the liquid source with a liquid;

providing the surface adjacent to the nozzle;

transporting one or more droplets from the liquid source to the nozzle such that at least a portion of the one or more droplets bulges outwardly toward the surface;

contacting the droplet with the surface; and moving the surface away from the nozzle.

15. The method of claim 14, wherein the liquid contains biological material.

16. The method of claim 14, wherein after the droplet contacts the surface, the surface is moved away from a stationary nozzle.

17. The method of claim 14, wherein after the droplet contacts the surface, the nozzle is moved away from a stationary surface.

18. A system for transferring liquid droplets comprising:

a nozzle having an orifice with an inner circumferential surface, wherein at least a portion of the inner circumferential surface is serrated, the inner circumferential surface being a non-wetting surface; and a printing surface comprising a wetting surface configured to receive liquid droplets from the nozzle.

19. The system of claim 18, wherein the non-wetting surface comprises a hydrophobic coating disposed on the inner circumferential surface of the orifice.

20. The system of claim 18, wherein the nozzle is configured to move relative the printing surface.

21. The system of claim 18, wherein the printing surface is configured to move relative to the nozzle.

22. The system of claim 18, wherein a liquid droplet is completely transferred from the nozzle to the printing surface leaving no residue at the nozzle.

23. The system of claim 18, wherein the liquid droplet contains biological material.

24. The system of claim 18, further comprising a channel fluidly coupled to the nozzle, the channel including at least one driving electrode configured to move a droplet within the channel.

* * * * *

UNITED STATES PATENT AND TRADEMARK OFFICE

CERTIFICATE OF CORRECTION

PATENT NO. : 7,458,661 B2
APPLICATION NO. : 11/275668
DATED : December 2, 2008
INVENTOR(S) : Kim et al.

It is certified that error appears in the above-identified patent and that said Letters Patent is hereby corrected as shown below:

Col. 1 line 63 replace “micro spotting” with -- microspotting --
Col. 1 line 66 replace “micro spotting” with -- microspotting --
Col. 2 line 28 replace “print head” with -- printhead --
Col. 2 line 33 replace “print head” with -- printhead --
Col. 2 line 33 replace “teat” with -- that --
Col. 2 line 47 replace “there” with -- their --
Col. 3 line 9 replace “micro channel” with -- microchannel --
Col. 3 line 53 replace “print head” with -- printhead --
Col. 3 line 62 replace “pate” with -- page --
Col. 4 line 21 replace “print head” with -- printhead --
Col. 4 line 33 replace “print head” with -- printhead --
Col. 4 line 43 replace “print head” with -- printhead --
Col. 4 line 54 replace “print head” with -- printhead --
Col. 4 line 63 replace “print head” with -- printhead --
Col. 5 line 13 replace “print head” with -- printhead --
Col. 5 line 15 replace “print head” with -- printhead --
Col. 5 line 16 replace “print head” with -- printhead --
Col. 5 line 33 replace “radically-oriented” with -- radially-oriented --
Col. 5 line 41 replace “print head” with -- printhead --
Col. 5 line 43 replace “radically-oriented” with -- radially-oriented --
Col. 5 line 55 replace “radically-oriented” with -- radially-oriented --
Col. 5 line 59 replace “radically-oriented” with -- radially-oriented --
Col. 5 line 62 replace “radically-oriented” with -- radially-oriented --
Col. 6 line 2 replace “print head” with -- printhead --
Col. 6 line 14 replace “print head” with -- printhead --
Col. 6 line 32 replace “motes” with -- moves --
Col. 6 line 32 replace “f” with -- of --
Col. 6 line 43 replace “that that” with -- that --
Col. 6 line 48 replace “print head” with -- printhead --

UNITED STATES PATENT AND TRADEMARK OFFICE

CERTIFICATE OF CORRECTION

PATENT NO. : 7,458,661 B2
APPLICATION NO. : 11/275668
DATED : December 2, 2008
INVENTOR(S) : Kim et al.

It is certified that error appears in the above-identified patent and that said Letters Patent is hereby corrected as shown below:

Col. 7 line 41 replace “safer” with -- wafer --
Col. 7 line 68 replace “photo resist” with -- photoresist --
Col. 8 line 46 replace “wet ability” with -- wettability --

Signed and Sealed this

Twelfth Day of May, 2009

John Doll

JOHN DOLL
*Acting Director of the United States Patent and Trademark Office*